US006974023B1

(12) United States Patent
Donaldson

(10) Patent No.: US 6,974,023 B1
(45) Date of Patent: Dec. 13, 2005

(54) EARRING ORGANIZING DEVICE

(76) Inventor: Laura L. Donaldson, 1094 Trout Brook Rd., Olmstedville, NY (US) 12857

( * ) Notice: Subject to any disclaimer, the term of this patent is extended or adjusted under 35 U.S.C. 154(b) by 93 days.

(21) Appl. No.: 10/441,317

(22) Filed: May 19, 2003

(51) Int. Cl.[7] ..... A45C 11/04
(52) U.S. Cl. ..... 206/6.1; 206/806
(58) Field of Search ..... 206/6.1, 566, 806, 206/495, 486, 279, 284, 286, 287, 287.1, 206/288, 289; 211/85.2, 113, 118; 217/5, 217/11; 383/117; 24/299; 135/87, 90, 96

(56) References Cited

U.S. PATENT DOCUMENTS 654,156 A * 7/1900 Johnson ..... 135/90
671,912 A * 4/1901 Woodward ..... 135/90
1,836,433 A * 12/1931 Batts ..... 206/279
2,259,926 A * 10/1941 Delvo ..... 24/299
3,298,503 A * 1/1967 Field et al. ..... 206/279
3,853,343 A * 12/1974 Hunter ..... 24/299
4,329,789 A * 5/1982 Erickson ..... 211/113
D285,634 S 9/1986 Mcbean
4,767,011 A * 8/1988 Butler ..... 211/85.2
5,050,745 A 9/1991 Sanders
5,117,971 A * 6/1992 Fisher ..... 206/6.1
5,121,833 A 6/1992 Lindsay et al.
5,143,214 A * 9/1992 Freelander et al. ..... 206/287
5,240,120 A 8/1993 McDonough
5,323,897 A * 6/1994 Sperber ..... 206/287
5,363,953 A 11/1994 Carter
5,427,230 A 6/1995 Mattox
5,494,066 A * 2/1996 McMahan ..... 135/90
5,605,232 A * 2/1997 Bickle ..... 206/287
5,906,277 A * 5/1999 Vienneau ..... 206/287.1
6,024,489 A * 2/2000 Fox et al. ..... 383/117
6,317,910 B1 * 11/2001 Wilson ..... 135/90
6,719,157 B2 * 4/2004 Stoddart et al. ..... 211/118

* cited by examiner

*Primary Examiner*—Luan K. Bui

(57) ABSTRACT

An earring organizing device for organizing and displaying a plurality of earrings. The earring organizing device includes a plurality of panels. Each of the panels has a side edge that is attached to one of the side edges of another of the panels such that the panels have a generally square cross-section in a plane perpendicular to the side edges. Each of the panels has a plurality of perforations extending therethrough. A brace is provided for keeping each of the panels in a predetermined fixed position with respect to each other. A hanging assembly is provided for hanging the panels from a surface.

14 Claims, 3 Drawing Sheets

EARRING ORGANIZING DEVICE

BACKGROUND OF THE INVENTION

1. Field of the Invention

The present invention relates to organizing devices and more particularly pertains to a new earring organizing device for organizing and displaying a plurality of earrings.

2. Description of the Prior Art

The use of organizing devices is known in the prior art. More specifically, organizing devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,121,833; U.S. Pat. No. 5,427,230; U.S. Pat. No. 5,050,745; U.S. Pat. No. 5,240,120; U.S. Pat. No. 5,363,953; and U.S. Patent No. Des. 285,634.

While these devices fulfill their respective, particular objectives and requirements, the aforementioned patents do not disclose a new earring organizing device. The inventive device includes a plurality of panels. Each of the panels has a side edge that is attached to one of the side edges of another of the panels such that the panels have a generally square cross-section in a plane perpendicular to the side edges. Each of the panels has a plurality of perforations extending therethrough. A brace is provided for keeping each of the panels in a predetermined fixed position with respect to each other. A hanging assembly is provided for hanging the panels from a surface.

In these respects, the earring organizing device according to the present invention substantially departs from the conventional concepts and designs of the prior art, and in so doing provides an apparatus primarily developed for the purpose of organizing and displaying a plurality of earrings.

SUMMARY OF THE INVENTION

In view of the foregoing disadvantages inherent in the known types of organizing devices now present in the prior art, the present invention provides a new earring organizing device construction wherein the same can be utilized for organizing and displaying a plurality of earrings.

The general purpose of the present invention, which will be described subsequently in greater detail, is to provide a new earring organizing device apparatus and method which has many of the advantages of the organizing device mentioned heretofore and many novel features that result in a new earring organizing device which is not anticipated, rendered obvious, suggested, or even implied by any of the prior art organizing devices, either alone or in any combination thereof.

To attain this, the present invention generally comprises a plurality of panels. Each of the panels has a side edge that is attached to one of the side edges of another of the panels such that the panels have a generally square cross-section in a plane perpendicular to the side edges. Each of the panels has a plurality of perforations extending therethrough. A brace is provided for keeping each of the panels in a predetermined fixed position with respect to each other. A hanging assembly is provided for hanging the panels from a surface.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new earring organizing device apparatus and method which has many of the advantages of the organizing devices mentioned heretofore and many novel features that result in a new earring organizing device which is not anticipated, rendered obvious, suggested, or even implied by any of the prior art organizing devices, either alone or in any combination thereof.

It is another object of the present invention to provide a new earring organizing device which may be easily and efficiently manufactured and marketed.

It is a further object of the present invention to provide a new earring organizing device which is of a durable and reliable construction.

An even further object of the present invention is to provide a new earring organizing device which is susceptible of a low cost of manufacture with regard to both materials and labor, and which accordingly is then susceptible of low prices of sale to the consuming public, thereby making such earring organizing device economically available to the buying public.

Still yet another object of the present invention is to provide a new earring organizing device which provides in the apparatuses and methods of the prior art some of the advantages thereof, while simultaneously overcoming some of the disadvantages normally associated therewith.

Still another object of the present invention is to provide a new earring organizing device for organizing and displaying a plurality of earrings.

Yet another object of the present invention is to provide a new earring organizing device which includes a plurality of panels. Each of the panels has a side edge that is attached to one of the side edges of another of the panels such that the panels have a generally square cross-section in a plane perpendicular to the side edges. Each of the panels has a plurality of perforations extending therethrough. A brace is provided for keeping each of the panels in a predetermined fixed position with respect to each other. A hanging assembly is provided for hanging the panels from a surface.

Still yet another object of the present invention is to provide a new earring organizing device that provides easy access to an assortment of earrings that are hanging on the earring organizing device.

Even still another object of the present invention is to provide a new earring organizing device that allows an individual to quickly determine if any earrings are missing by easily observing an entire earring collection stored on the earring organizing device.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
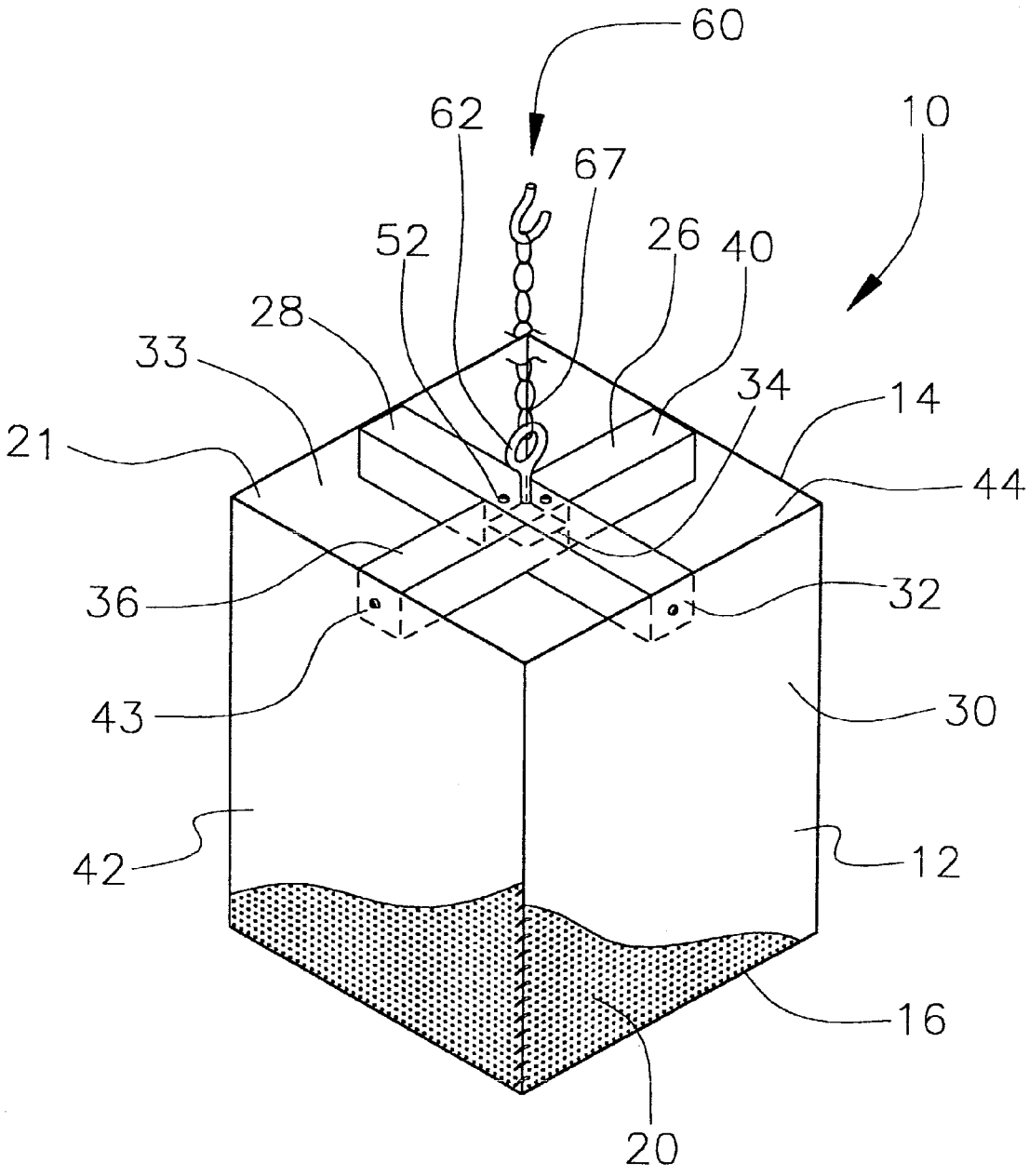
FIG. 1 is a schematic perspective view of a new earring organizing device according to the present invention showing a plurality of panels attached to a brace member, suspended from a surface.
Figure 2:
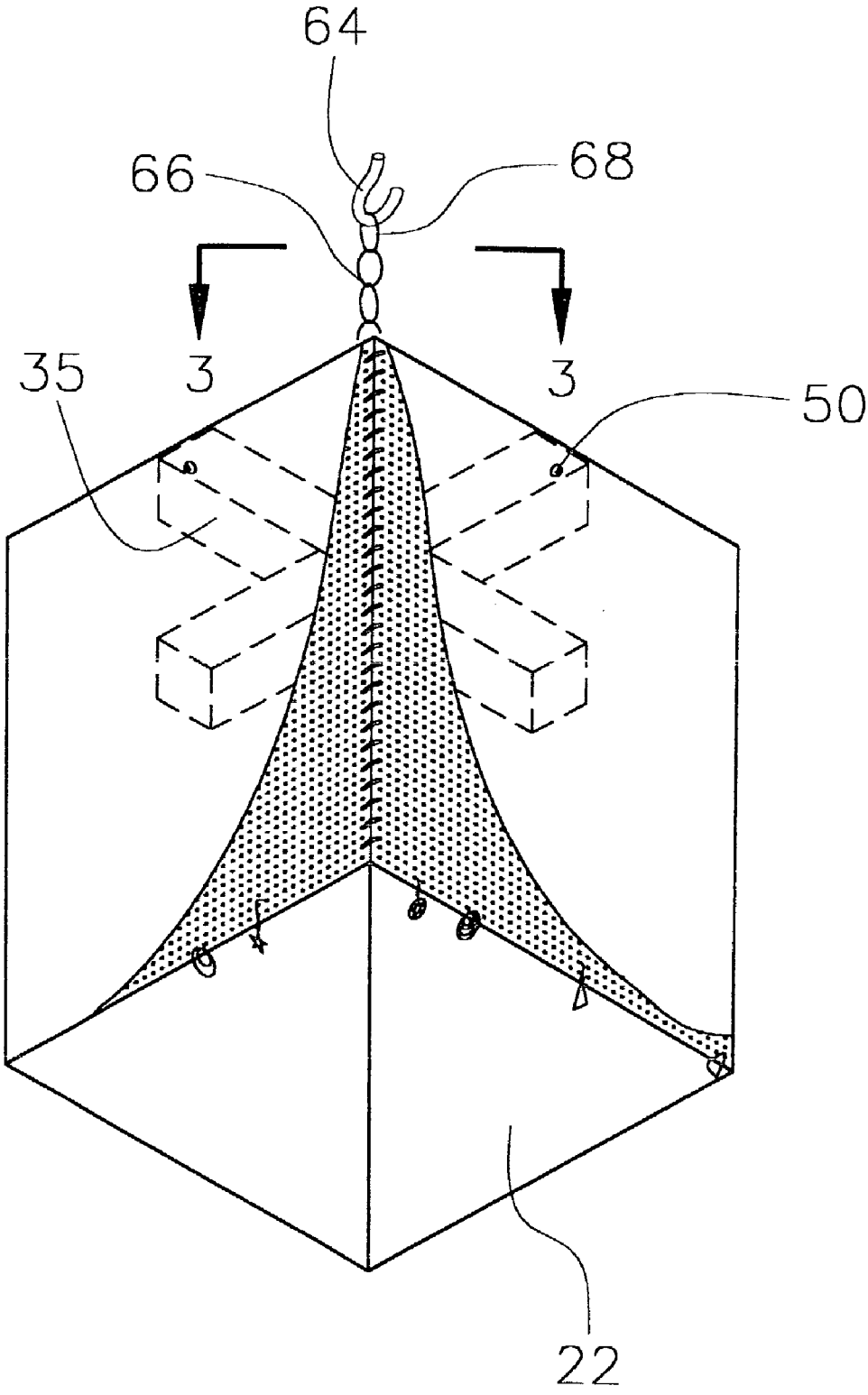
FIG. 2 is a schematic perspective view of the present invention showing the bottom of the present with earrings hanging from a pair of the panels.
Figure 3:
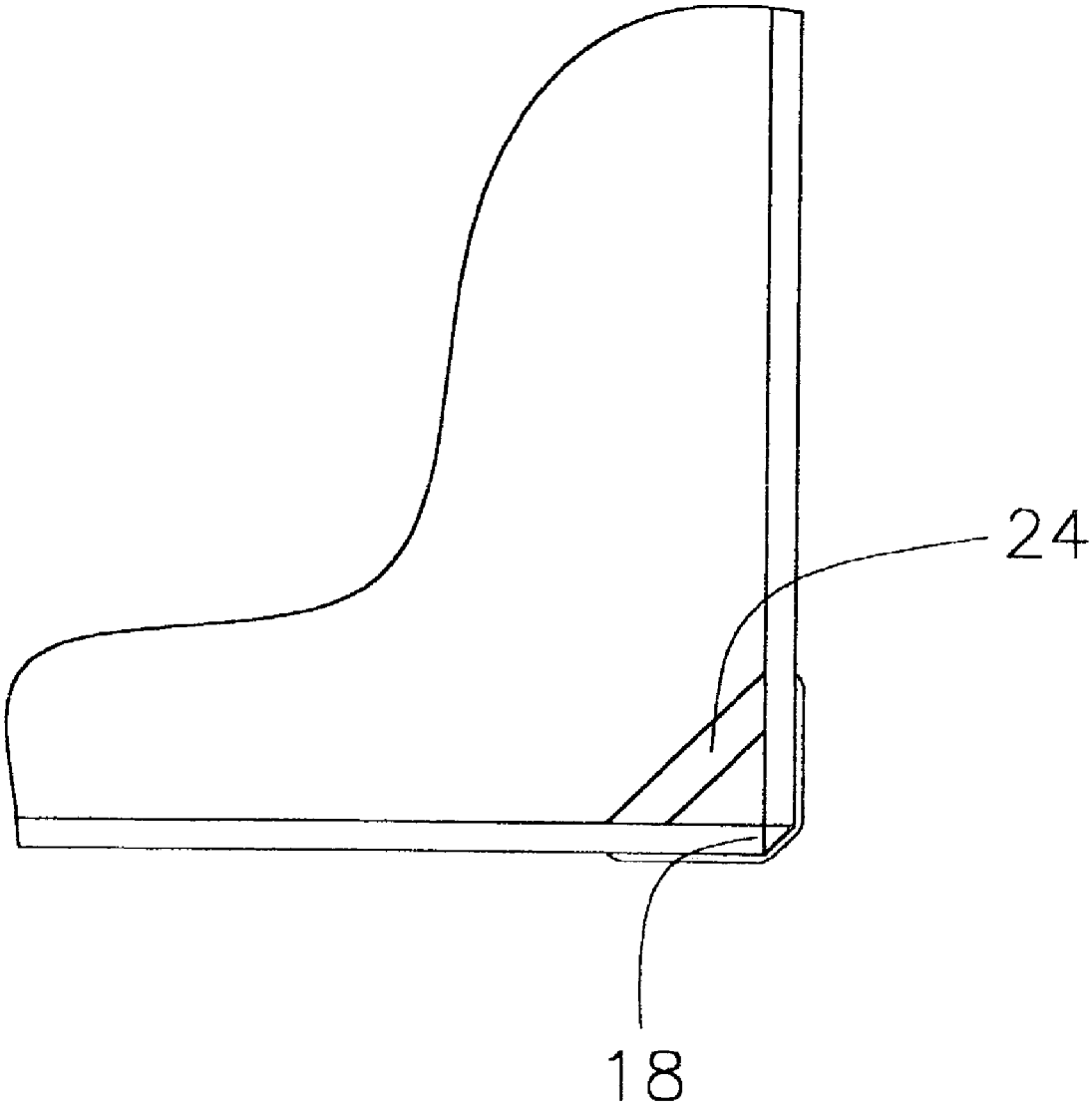
FIG. 3 is a schematic top view of the present invention taken along line 3—3 of FIG. 2 showing a fastening means fastening a pair of side edges of the panels together.

With reference now to the drawings, and in particular to FIGS. 1 through 3 thereof, a new earring organizing device embodying the principles and concepts of the present invention and generally designated by the reference numeral 10 will be described.

As best illustrated in FIGS. 1 through 3, the earring organizing device 10 generally comprises a plurality of panels 12. Each of the panels 12 has a top edge 14, a bottom edge 16 and a pair of side edges 18. Each of the panels 12 has a plurality of perforations 20 extending therethrough for hanging a plurality of earrings from each of the panels 12. Each of the perforations 20 is spaced apart from each other. Each of the side edges 18 of one of the panels 12 is attached to one of the side edges 18 of another of the panels 12 such that the plurality of panels 12 have a generally square cross-section in a plane extending perpendicular to the side edges 18. The top edge 14 of each of the panels 12 collectively define an open top 20 and the bottom edge 16 of each of the panels collectively define an open bottom 22. Each of the panels 12 may comprise a generally rigid material such as, a plastic canvas sheet. In one exemplary embodiment of the invention, the panels 12 have a length measuring approximately thirteen and one-half inches from the top edge 14 to the bottom edge 16, and a width measuring approximately ten and one-half inches between each of the side edges 18.

A fastening means 24 may be provided for fastening each of the side edges 18 of the panels 12 together. The fastening means 24 may comprise an elongated flexible member interwoven into the perforations 20 of adjacent panels 12 in order to link the panels 12 together. The elongated flexible member extends through one of the perforations 20 of one of the panels 12 and extends into a perforation 20 of another one of the panels 12. The elongated flexible member may comprise a yarn material. The elongated flexible member may have a length measuring approximately four and one-half yards, depending upon the size of the panels being fastened together.

A brace 26 is provided for keeping each of the panels 12 in a predetermined fixed position with respect to each other. The brace 26 may comprise a first bar 28 that extends between a first pair 30 of the panels 12. The first bar 28 has a pair of ends 32 that are attached to an inner surface 33 of one of the first pair 30 of the panels 12 and positioned generally adjacent to the top edge 14 of the first pair 30 of the panels 12. The first bar 28 has a notch 34 extending therein. The notch 34 extends from a bottom side 35 of the first bar 28 toward a top side 36 of the first bar 28. The notch 34 may be positioned generally an equal distance from each of the ends 32 of the first bar 28. The first bar 28 may comprise a substantially rigid material such as, for example, a plastic, metal or wood material.

A second bar 40 is removably positionable in the notch 34 of the first bar 28 and extends between a second pair 42 of the panels 12. The second bar 40 has a pair of ends 43 that are attached to an inner surface 44 of each of the second pair 42 of the panels 12 and adjacent to the top edge 14 of the second pair 42 of the panels 12. The second bar 40 may be positioned generally perpendicular to the first bar 28. The second bar may comprise a substantially rigid material such as, for example, a plastic, metal, or wood material. Each of the bars 28 and 40 may have a length measuring approximately ten and one-half inches long from each of said ends 32 and 43. Each of the bars 28 and 40 may also have a width measuring approximately one and one-half inches.

A first securing means 50 may be provided for securing each of the panels 12 to one of the ends 32 and 43 of the first 28 and second 40 bars. The first securing means 50 extends through one of the panels 12 and into one of the ends 32 and 43 of the first 28 and second 40 bars. Preferably, the first securing means 50 comprises a fastener such as, for example, a screw.

A second securing means 52 may be provided for securing the second bar 40 to the first bar 28. The second securing means 52 is preferably positioned at a juncture of the first 28 and second 40 bars. The second securing means 52 extends in the top side 36 of the first bar 28 and into the second bar 40. Preferably, the second securing means 52 comprises a fastener such as, for example, a screw.

A hanging assembly 60 may be provided for hanging the panels 12 from a surface. The hanging assembly 60 preferably comprises a loop such as formed by an eye screw 62 that may be attached to and extend upwardly from the top side 36 of the first bar 28. The eye screw 62 may be positioned generally between the second securing means 52.

The hanging assembly 60 may also preferably include a hook formed by a hook screw 64 that is attachable to a surface such as, for example, a ceiling for extending downwardly therefrom.

A securing member 66 may be provided for securing the eye screw 62 to the hook screw 64. The securing member 66 has a first end 67 and a second end 68. The first end 67 is releasably couplable to the eye screw 62. The second end 68 of the securing member 66 is releasably couplable to the hook screw 64. The securing member 66 may comprise, for example, a chain or optionally, a piece of cord or rope.

In use, posts of the earrings are inserted into the perforations 20 extending through each of the panels 12 for organization and display.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An earring organizing device for organizing earrings, said device comprising:

a plurality of panels, each of said panels having a side edge being attached to one of said side edges of another of said panels such that said plurality of panels form a perimeter wall defining an interior space, the perimeter wall having a lower edge defining an opening into said interior space, each of said panels having a plurality of perforations extending therethrough;

a brace for keeping each of said panels in a predetermined fixed position; and a hanging assembly for hanging said brace from a surfaces;

wherein the perimeter wall has an upper edge defining an opening into said interior space.

2. The earring organizing device of claim 1, additionally comprising:

a fastening means for fastening each of said side edges of said panels together.

3. The earring organizing device of claim 2, wherein said fastening means comprises an elongated flexible member, said elongated flexible member extending through at least one of said plurality of perforations of a pair of adjacent said panels.

4. The earring organizing device of claim 1, wherein said brace comprises:

a first bar extending between a first pair of said panels, said first bar having a notch extending therein; and a second bar being removably positionable in said notch of said first bar and extending between a second pair of said panels.

5. The earring organizing device of claim 4, wherein said first bar has a pair of ends, each of said ends is attached to an inner surface of one of said first pair of said panels, said notch extends from a bottom side of said first bar toward a top side of said first bar, said notch being positioned a generally distance from each of said ends of said first bar.

6. The earring organizing device of claim 4, wherein said second bar has a pair of ends, each of said ends being attached to an inner surface of said second pair of said panels.

7. The earring organizing device of claim 4, additionally comprising:

a first securing means for securing each of said panels to one of a pair of ends of said first and second bars.

8. The earring organizing device of claim 4, additionally comprising:

a second securing means for securing said second bar to said first bar, said second securing means extending into a top side of said first bar and into said second bar.

9. The earring organizing device of claim 1, wherein said plurality of panels form a substantially cubic structure, said substantially cubic structure.

10. The earring organizing device of claim 1, wherein said brace comprises a pair of bars arrange in a crossed orientation.

11. The earring organizing device of claim 10, wherein said bars each have opposite ends, each of the opposite ends, each of the opposite ends of the bars being attached to one said panel of said plurality of panels.

12. The earring organizing device of claim 1 wherein the perimeter wall formed by said plurality of panels has a generally square cross-section in a plane perpendicular to said side edges.

13. The earring organizing device of claim 1 wherein the perimeter wall has an upper edge, and wherein the interior space defined by said perimeter wall is open from said upper edge of said perimeter wall to the opening at said lower edge.

14. An earring organizing device for organizing earrings, said device comprising:

a plurality of panels, each of said panels having a top edge, a bottom edge and a pair of side edges, each of said panels having a plurality of perforations extending therethrough, each of said perforations being spaced apart from each other, each of said side edges of one of said panels being attached to one of said side edges of another of said panels such that said plurality of panels have a generally square cross-section in a plane perpendicular to said side edges, said top edge of each of said panels defining an open top and said bottom edge of each of said panels defining an open bottom;

a fastening means for fastening each of said side edges of said panels together, said fastening means comprising an elongated flexible member, said elongated flexible member extending through at least one of said perforations of a pair of adjacent said panels, said elongated flexible member comprising a yarn material;

a brace for keeping each of said panels in a predetermined fixed position with respect to each other, said brace comprising:

a first bar extending between a first pair of said panels, said first bar having a pair of ends, each of said ends being attached to an inner surface of one of said first pair of said panels and positioned generally adjacent to said top edge of said first pair of said panels, said first bar having a notch extending therein, said notch extending from a bottom side of said first bar toward a top side of said first bar, said notch being positioned a generally distance from each of said ends of said first bar, said first bar comprising a substantially rigid material;

a second bar being removably positionable in said notch of said first bar and extending between a second pair of said panels, said second bar having a pair of ends, each of said ends being attached to an inner surface of said second pair of said panels and adjacent to said top edge of said second pair of said panels, said second bar being positioned generally perpendicular to said first bar, said second bar comprising a substantially rigid material;

a first securing means for securing each of said panels to one of said ends of said first and second bars each of said securing means extending through one of said panels and into one of said ends of said first and second bars, said securing means comprising a screw;

a second securing means for securing said second bar to said first bar, each of said second securing means being positioned at a juncture of said first and second bars, each of said second securing means extending in said top side of said first bar and into said second bar, each of said second securing means comprising a screw a hanging assembly for hanging said brace from a surface, said hanging assembly comprising:

an eye screw being attached to and extending upwardly from said top side of said first bar, said eye screw being positioned generally between said second securing means;

a hook screw being attached to and extending downwardly from a surface;

a securing member for securing said eye screw to said hook screw, said securing member having a first end and a second end, said first end being releasably couplable to said eye screw, said second end of said securing member being releasably couplable to said hook screw, said securing member comprising a chain.

* * * * *